US009534425B2

(12) United States Patent
Hunt et al.

(10) Patent No.: US 9,534,425 B2
(45) Date of Patent: Jan. 3, 2017

(54) LOCK FOR A MOTOR VEHICLE

(71) Applicant: Kiekert AG, Heiligenhaus (DE)

(72) Inventors: Robert J. Hunt, Davisburg, MI (US); Keith Julien, Canton, MI (US)

(73) Assignee: Kiekert AG, Heiligenhaus (DE)

( * ) Notice: Subject to any disclaimer, the term of this patent is extended or adjusted under 35 U.S.C. 154(b) by 89 days.

(21) Appl. No.: 14/097,529

(22) Filed: Dec. 5, 2013

(65) Prior Publication Data

US 2015/0159408 A1 Jun. 11, 2015

(51) Int. Cl.
*E05C 3/16* (2006.01)
*E05B 77/06* (2014.01)
*E05B 85/26* (2014.01)

(52) U.S. Cl.
CPC ..... *E05B 77/06* (2013.01); *E05B 85/26* (2013.01); *Y10T 292/702* (2015.04)

(58) Field of Classification Search
CPC ..... E05B 77/02; E05B 77/04; E05B 77/06; E05B 77/12; E05B 85/24; E05B 85/26
USPC ..... 292/201, 216, DIG. 22, DIG. 23, DIG. 65,292/92, 194, 196, 198
See application file for complete search history.

(56) References Cited

U.S. PATENT DOCUMENTS 5,865,481 A * 2/1999 Buschmann ..... 292/216
6,010,165 A * 1/2000 Santarelli et al. ..... 292/216
2009/0322105 A1* 12/2009 Lee et al. ..... 292/237
2010/0052336 A1* 3/2010 Bendel et al. ..... 292/196
2011/0204660 A1* 8/2011 Cumbo et al. ..... 292/217
2012/0068480 A1* 3/2012 Bendel et al. ..... 292/220
2013/0056997 A1* 3/2013 Mittelbach et al. ..... 292/198
2014/0203575 A1* 7/2014 Brickner et al. ..... 292/341.17
2014/0284939 A1* 9/2014 Wittelsbuerger et al. ..... 292/92
2014/0284941 A1* 9/2014 Wittelsbuerger et al. ..... 292/92
2014/0291998 A1* 10/2014 Pettengill ..... E05B 85/26 292/96
2015/0028601 A1* 1/2015 Rosales et al. ..... 292/92

FOREIGN PATENT DOCUMENTS

DE 102012025403 A1 * 6/2014 ..... E05B 77/06
DE 102013203808 9/2014
EP 1518983 A2 3/2005
WO WO 2013046317 A1 * 4/2013

* cited by examiner

*Primary Examiner* — Alyson M Merlino
(74) *Attorney, Agent, or Firm* — Renner, Otto, Boisselle & Sklar, LLP

(57) ABSTRACT

A lock for a motor vehicle includes a locking mechanism with a rotatably mounted rotary catch for receiving a locking bolt, and a pawl with which the rotary catch can be engaged for retaining the locking bolt. The lock further includes a blocking lever that blocks the pawl when the pawl is located in a catching position, and a releasing lever for disengaging the locking mechanism. A first spring interconnects the blocking lever and the releasing lever, wherein the blocking lever and the releasing lever move either together or independently relative to the first spring based on a magnitude of acceleration of the releasing lever.

14 Claims, 7 Drawing Sheets

LOCK FOR A MOTOR VEHICLE

FIELD OF THE INVENTION

The invention relates to a lock for a motor vehicle.

DESCRIPTION OF THE RELATED STATE OF THE ART

A conventional lock for a motor vehicle includes a locking mechanism with a rotatably mounted rotary catch for receiving a locking bolt, also referred to as a striker. The locking mechanism moreover includes a pawl with which the rotary catch can be engaged for retaining the locking bolt.

The rotary catch of a motor vehicle lock usually has a fork-shaped inlet slot (also referred to as an inlet opening) which is formed by the load arm and the catching arm into which the locking bolt (also known as a striker) of a vehicle door or hatch, e.g. a hood or a trunk lid, enters when the door or hatch is closed. The locking bolt or striker then turns the rotary catch from an opened position in the direction of the closed position until the pawl engages the rotary catch. This position is referred to as the catching position. The locking bolt then cannot leave the inlet slot of the rotary catch.

Furthermore, a lock can include a blocking lever capable of blocking the pawl in its catching position. The blocking lever has to be pivoted or turned out of its blocking position to disengage the locking mechanism. The pawl is able to leave its catching position for opening the locking mechanism, if the blocking lever has been removed from its blocking position.

There are locks, such as known from U.S. 2,010,052 336 A1, in which the rotary catch is capable of introducing an opening moment into the pawl if the latter is in its catching position. Such a lock requires a blocking lever in order to be able to engage the locking mechanism. Such locks can be opened with little effort.

There are motor vehicle locks with two catching positions, i.e. a preliminary catching position and a main catching position. The preliminary catching position serves for rotary catching the respective door or hatch when the latter does not reach the main catching position during the closing process. If, starting from the preliminary catching position, the rotary catch is turned further correspondingly, it will finally reach the main catching position.

A conventional lock further includes a releasing lever which is actuated in order to open or disengage a locking mechanism. Such a releasing lever is typically connected to a handle of a door or hatch. If the handle is actuated, the releasing lever is actuated, or pivoted, in order to disengage the locking mechanism and thus open the lock.

In the event of a crash, the handle may be actuated inadvertently, which would lead to the locking mechanism being opened. It should be ensured that such a lock does not open inadvertently in such a case.

In order to ensure that a lock does not open inadvertently in the event of a crash, a lock with a locking mechanism is provided according to document EP 1518983 A2, which includes at least one actuating lever for releasing or opening the locking mechanism, i.e. a releasing lever. The lock moreover includes a blocking lever which blocks the actuating lever during predetermined vehicle accelerations.

In the event of a crash, particularly large accelerations occur, compared with a usual opening process. If the actuating lever blocks only at large vehicle accelerations, such as occur in the event of a crash, an unintentional opening of the locking mechanism in the case of a crash can be prevented. In the case of a usual actuation of the door handle, the actuating lever is not blocked for lack of a great acceleration to enable the lock to be opened.

In order to prevent an inadvertent opening in the event of a crash, a lock with a locking mechanism includes a rotary catch and a pawl for engaging the rotary catch. Furthermore, the lock includes a blocking lever capable of blocking the pawl if the latter is located in its catching position. Moreover, a releasing lever for opening or releasing the locking mechanism is provided. If the releasing lever is actuated, the pawl or the blocking lever is thereby moved out of its blocking position if the releasing lever is not excessively accelerated. If excessively large accelerations of the releasing lever occur, as can be caused by a crash, then an arresting device of the lock prevents the releasing lever from being able to move the pawl or the blocking lever out of its blocking or latching position, respectively. The lock is, therefore, incapable of opening if the releasing lever is accelerated in the event of a crash. The arresting device includes an inertia lever and a blocking lever. The inertia lever and the blocking lever are interconnected in such a way that the inertia lever is moved together with the blocking lever by the releasing lever only when the releasing lever is accelerated in the usual manner, as is the case when the door handle is actuated in the usual way, for example, by a driver of the vehicle. In such a case, the joint movement of the inertia lever and the blocking lever takes place in such a way that the blocking lever is incapable of preventing the locking mechanism from being opened. If the releasing lever is greatly accelerated, as in the event of a crash, then due to the inertia of the inertia lever, only the blocking lever is moved, namely into a position which blocks further pivoting of the releasing lever in such a way that the locking mechanism is prevented from being opened.

According to the German patent application 102013203808, the arresting device includes a spring which interconnects the inertia lever and the blocking lever in such a way that the blocking lever is moved together with the inertia lever by the releasing lever only when the releasing lever is accelerated in the usual manner. This prevents a lock from being able to open unintentionally in the event of a crash. Acceleration in a usual manner means that there is no excessively large accelerations of the releasing lever (as a rule due to a crash).

SUMMARY OF THE INVENTION

It is an object of the invention to provide a lock for a motor vehicle including a mechanism which prevents an inadvertent opening in the event of a crash.

Another object of the invention is to provide a lock for a motor vehicle having a reduced number of components.

Another object of the invention is to provide a lock for a motor vehicle having a reduced package size and a reduced overall mass.

In order to solve the object of the invention, a lock for a motor vehicle comprises a locking mechanism with a rotatably mounted rotary catch for receiving a locking bolt, a pawl with which the rotary catch can be engaged for retaining the locking bolt, a blocking lever capable of blocking the pawl if the latter is located in its engaging position, and a releasing lever for disengaging the locking mechanism, wherein the blocking lever and the releasing lever are interconnected by a first spring. The blocking lever and the releasing lever move either together or independently relative to the first spring based on a magnitude of acceleration of the releasing lever.

The first spring interconnects the releasing lever and the blocking lever in such a way that the blocking lever is moved together with the releasing lever when the releasing lever is accelerated in the usual manner. Due to the inertia of the blocking lever, the blocking lever is not moved together with the releasing lever when the releasing lever is accelerated in an excessively large manner.

Due to first the spring connection, there is a mechanism which prevents an inadvertent opening in the event of a crash. A separate inertia lever is not necessary. As a result, there are a reduced number of components, a reduced package size and a reduced overall mass.

Preferably, the mass of the blocking lever is more than two times larger than the mass of the releasing lever. In another embodiment, the mass of the blocking lever is more than three times larger than the mass of the releasing lever. As a result, the inertia mass of the blocking lever is large.

In an embodiment of the invention, the blocking lever and the releasing lever may rotate around the same axis. This embodiment allows a simple construction of the spring connection. It is, for example, sufficient that one leg of the first spring is attached to the releasing lever and the other leg of the spring is attached to the blocking lever. In addition, the first spring may surround the axis. Preferably, the first spring is situated between the blocking lever and the releasing lever in order to enable a simple construction.

The present invention also refers to lock for a motor vehicle comprising a locking mechanism with a rotatably mounted rotary catch for receiving a locking bolt, a pawl with which the rotary catch can be engaged for retaining the locking bolt, a blocking lever capable of blocking the pawl if the latter is located in a main catching position as well as in a preliminary catching position, a releasing lever for disengaging the locking mechanism if the pawl is in a main catching position as well as in a preliminary catching position, wherein rotary catch introduces an opening moment into the pawl when the pawl is in a catching position. It is very easy to open the lock independent of whether the lock is in the main locking position or in the preliminary locking position. The lock comprises a reduced number of parts.

DETAILED DESCRIPTION OF THE INVENTION

Figure 1:
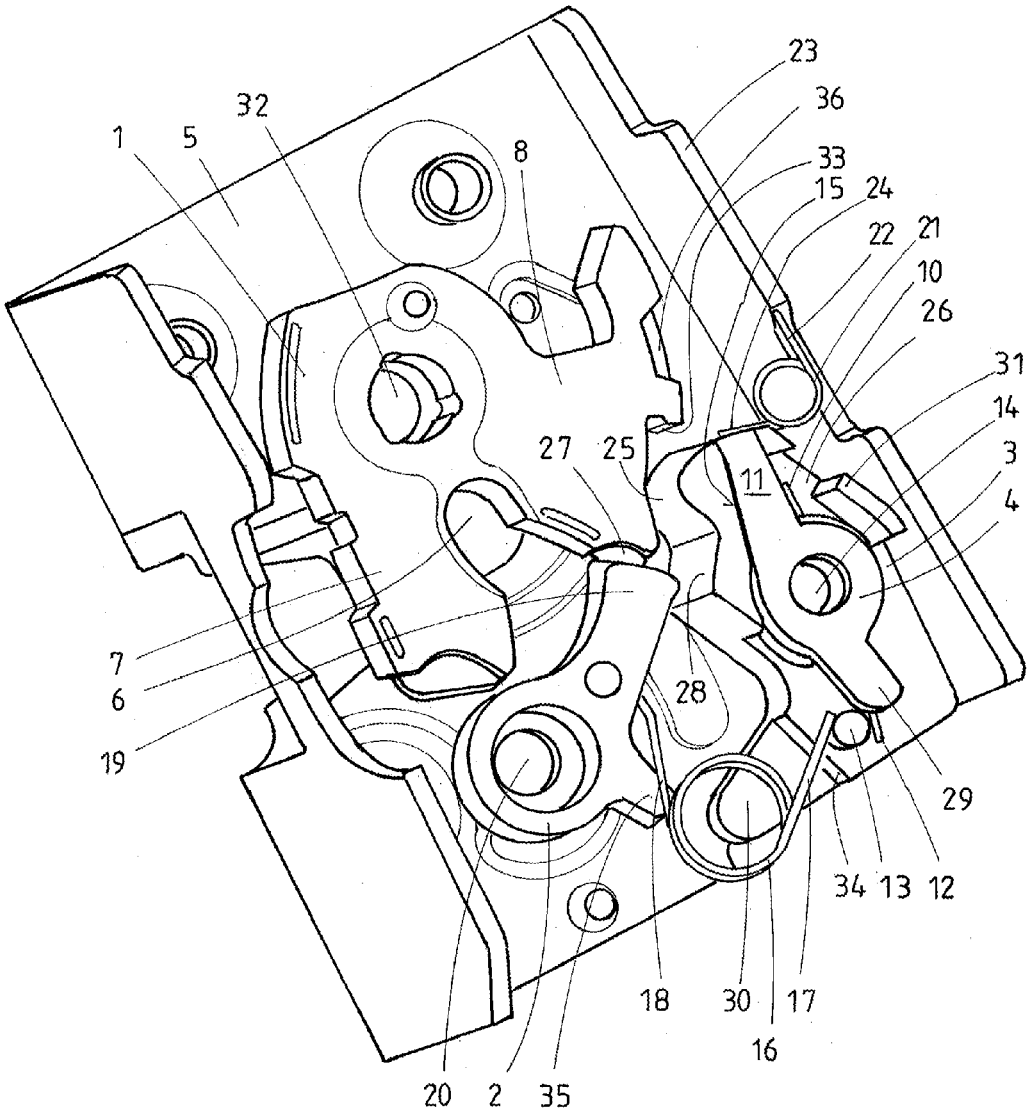
FIG. 1 is a perspective view of a locking mechanism in its main locking position in accordance with an exemplary embodiment of the invention.

As shown in FIG. 1, the locking mechanism of a lock includes a rotary catch 1, a pawl 2, a blocking lever 3 and a releasing lever 4 above the blocking lever 3. Rotary catch 1, pawl 2, blocking lever 3 and releasing lever 4 are rotatably mounted on a metal plate 5. The rotary catch 1 includes a fork-shaped inlet slot 6 which is formed by a load arm 7 and a catching arm 8 into which a locking bolt (not shown) enters when the corresponding door or hatch is closed. The locking bolt then turns the rotary catch 1 from an opened position in the direction of the closed position until the pawl 2 engages the rotary catch 1 in its main catching position as shown in FIG. 1.

In the main catching position respectively shown in FIG. 1, the rotary catch 1 introduces an opening moment into the pawl 2. Since the pawl 2 is blocked by the blocking lever 3, the pawl 2 rests in its catching position. Thus, the blocking lever 3 has to be pivoted out of its blocking position in order to disengage the locking mechanism.

Figure 2:
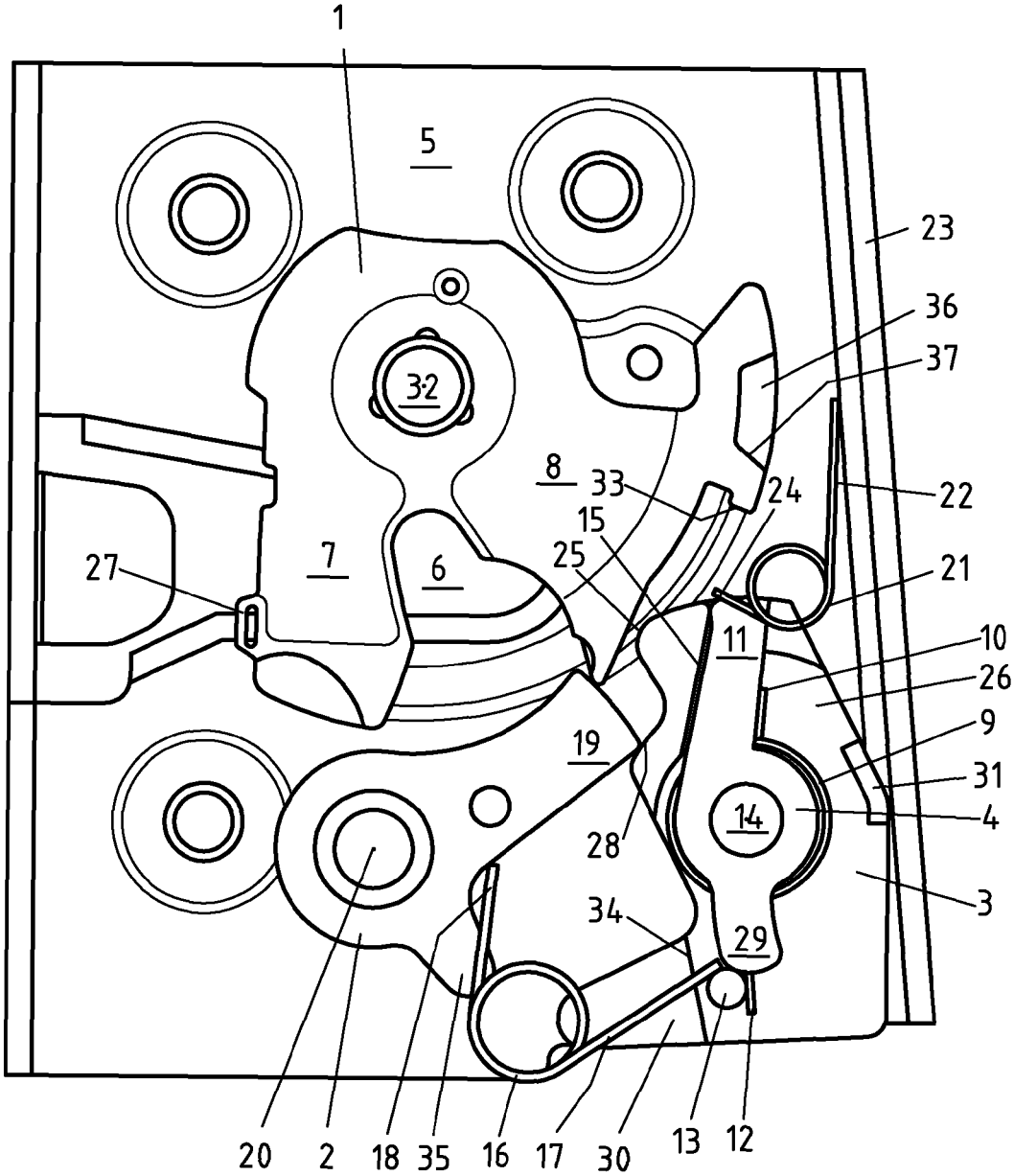
FIG. 2 is a top view of the locking mechanism in its main locking position in accordance with the exemplary embodiment of the invention.

The blocking lever 3 and the releasing lever 4 are interconnected by a first spring 9 (FIG. 2). One leg 10 of the first spring 9 rests against one arm 11 of the releasing lever 4 in a pre-stressed manner. The other leg 12 of the first spring 9 rests against a pin 13 of the blocking lever 3 in a pre-stressed manner. The first spring 9 is situated between the blocking lever 3 and the releasing lever 4. The blocking lever 3 and the releasing lever 4 may rotate around the same axis 14. The first spring 9 surrounds the axis 14. Therefore, the axis 14 holds the first spring 9 in its position. The first spring 9 interconnects the releasing lever 4 and the blocking lever 3 in such a manner that it is possible to remove the blocking lever 3 from its blocking position by rotating the releasing lever 4, if the acceleration of the releasing lever 4 is not excessively large. In other words, the blocking lever and the releasing lever move either together or independently relative to the first spring based on a magnitude of acceleration of the releasing lever.

The mass of the blocking lever 3 is at least two times larger than the mass of the releasing lever 4. Due to the large mass of the blocking lever 3, the blocking lever 3 acts like an inertia lever as described above.

As shown in FIG. 1, the arm 11 of the releasing lever 4 rests against an elevation forming a side wall 15 of the blocking lever 3 in the locking position of the lock. The side wall elevation 15 acts as a stop for the releasing lever 4. In the locking position, the side wall 15 prevents a turning movement of the releasing lever 4 in the counter-clockwise direction due to the pre-stressed first spring 9.

A further pre-stressed second spring 16 includes a first leg 17 which rests against the pin 13 of the blocking lever 3, and thus against the blocking lever 3. The pin 13 is situated between the leg 12 of the first spring 9 and the leg 17 of the second spring 16. The second spring 16 includes a second leg 18 which rests against an arm 19 of the pawl 2 adjacent the axis 20 of the pawl 2. The second spring 16 is able to move the blocking lever 3 in its blocking position. Furthermore, the second spring 16 is able to keep the blocking lever 3 in its blocking position. Since the second leg 18 ends adjacent the axis 20 of the pawl 2, the spring 16 does not introduce a significant moment into the pawl 2, which prevents the pawl 2 from leaving its catching position when the blocking lever 3 is removed from its blocking position.

There is a third pre-stressed spring 21. One leg 22 of the third spring 21 rests against a side wall 23 of the metal plate 5. The further leg 24 of the third spring 21 rests against an end portion of an arm 11 of the releasing lever 4. The side wall 31 is attached to the arm 26. The metal plate 5 is part of a housing.

In the main locking position, a first section respectively of surface 27 of the contour of the catching lever 8 rests against an end portion of the arm 19 of the pawl 2 as shown in FIG. 1. At the same time, a contour nearby this end portion of the arm 19 rests against a surface 28 of the contour of the blocking lever nearby the end portion of the arm 26 of the blocking lever 3. As a result, the pawl 2 cannot leave its main catching position.

A handle (not shown) is connected with a further arm 29 of the releasing lever 4. Activation of the handle rotates the releasing lever 4 in a clockwise manner in order to open the locking mechanism.

The pin 13 is attached to an arm 30 of the blocking lever 3. A further side wall elevation 31 of the blocking lever 3 in the neighborhood of its axis 14 may act as a further stop for the releasing lever 4 in order to limit a turning movement of the releasing lever 4 relative to the blocking lever 3 in a clockwise manner.

The rotary catch 1 can rotate around its axis 32. The catching lever 8 includes a second section 33 for a preliminary catching position. The second section 33 is part of the contour of the rotary catch 1.

The end portion of the arm 26 of the blocking lever 3 includes a rounded tongue 25 directed toward the end portion of the catching arm 8 when the locking mechanism is in a locking position.

The arm 30 of the blocking lever 3 includes a step 34 in order to provide space for the spring 16. The pawl 2 includes a second arm 35.

Figure 3:
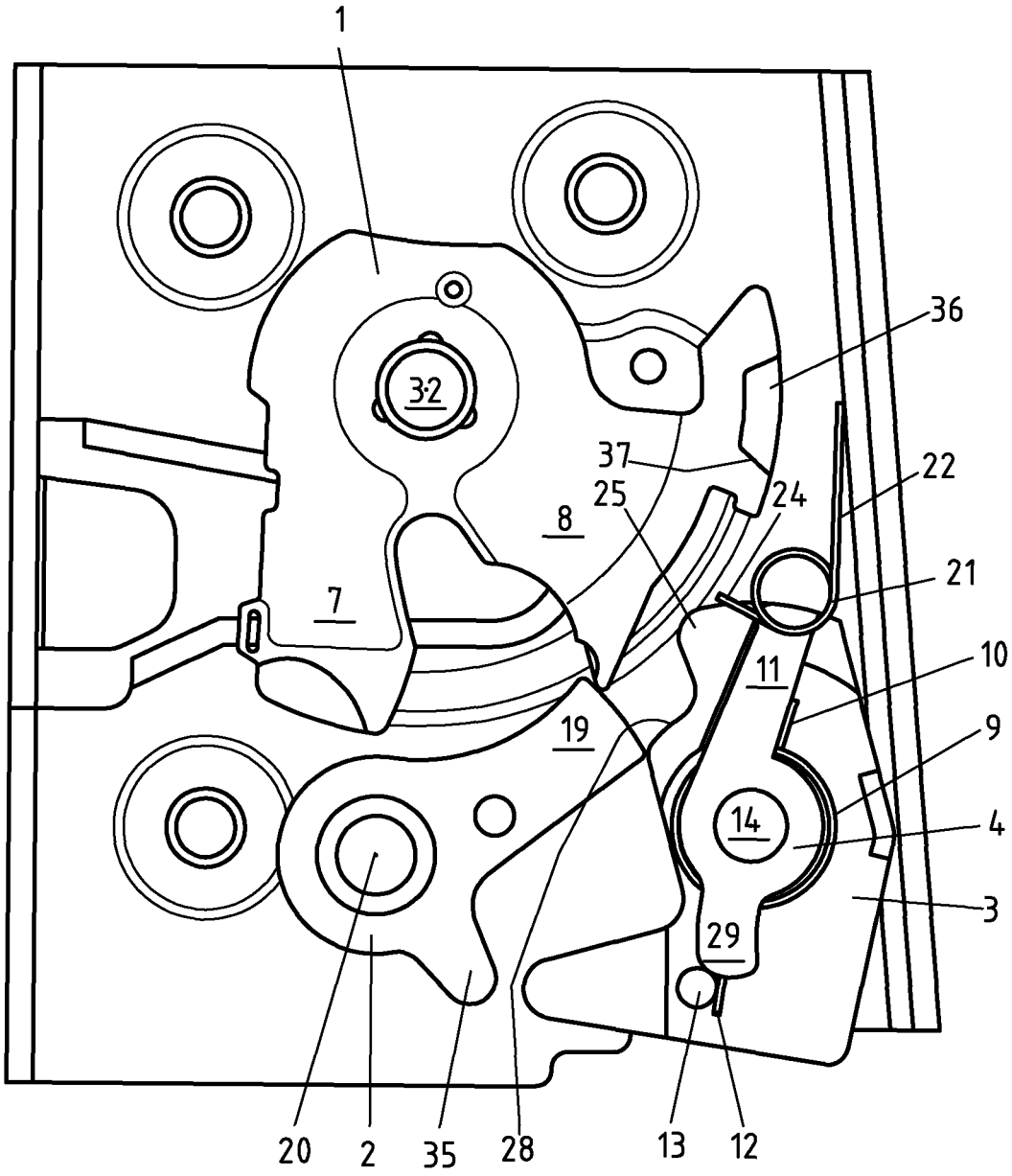
FIG. 3 is a top view of the locking mechanism when the blocking lever leaves its blocking position in accordance with the exemplary embodiment of the invention.

If the corresponding handle is activated in a usual manner in order to open a corresponding door or hatch, the turning movement of the releasing lever 4 is slow. The first spring 9 does not deflect. The releasing lever 4, the first spring 9 and the blocking lever 3 rotate as a rigid member in a clockwise direction as illustrated in FIG. 3. When the blocking lever 3 has left its blocking position in accordance with FIG. 3, the pawl 2 rotates in a clockwise manner due to the opening moment introduced by the rotary catch 1. The force required to rotate the blocking lever 3 in the clockwise direction is greatly reduced as the majority of the resistance from the seal load is passed through the pawl 2 instead. Once the blocking lever 3 is disengaged from the pawl 2, the pawl 2 self opens because of a positive pressure angle between it and the rotary catch 1.

Figure 4:
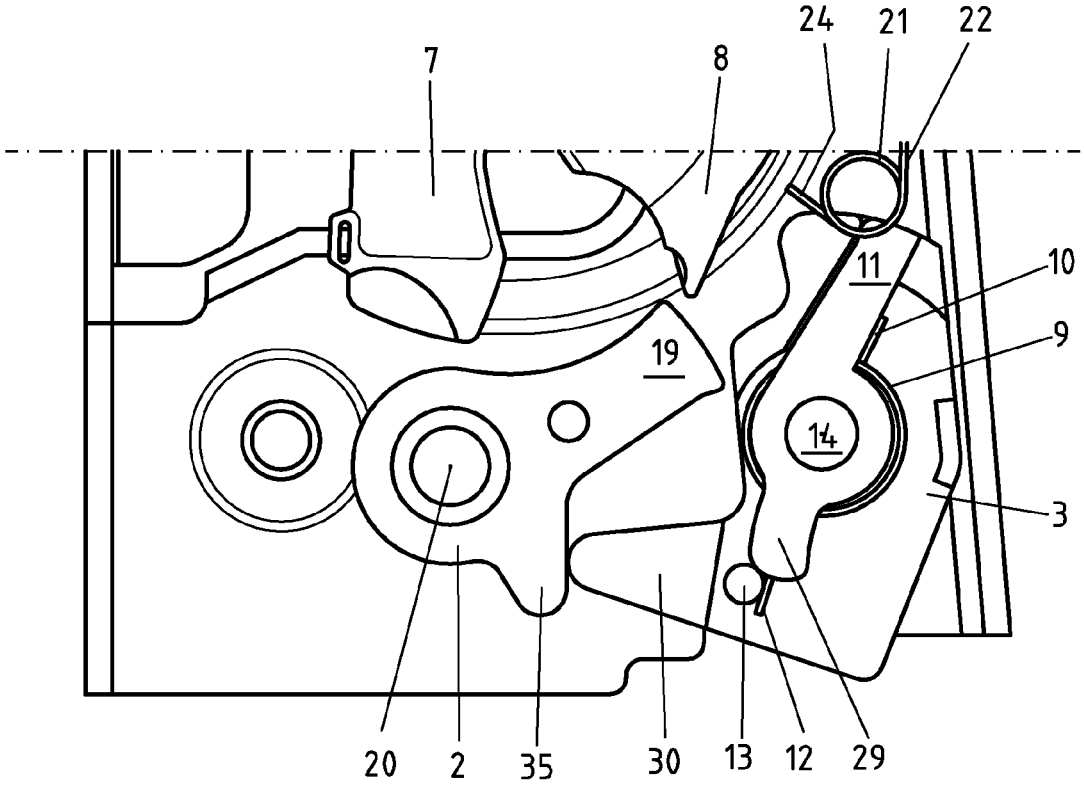
FIG. 4 is a top view of the locking mechanism when the pawl leaves its catching position in accordance with the exemplary embodiment of the invention.
Figure 5:
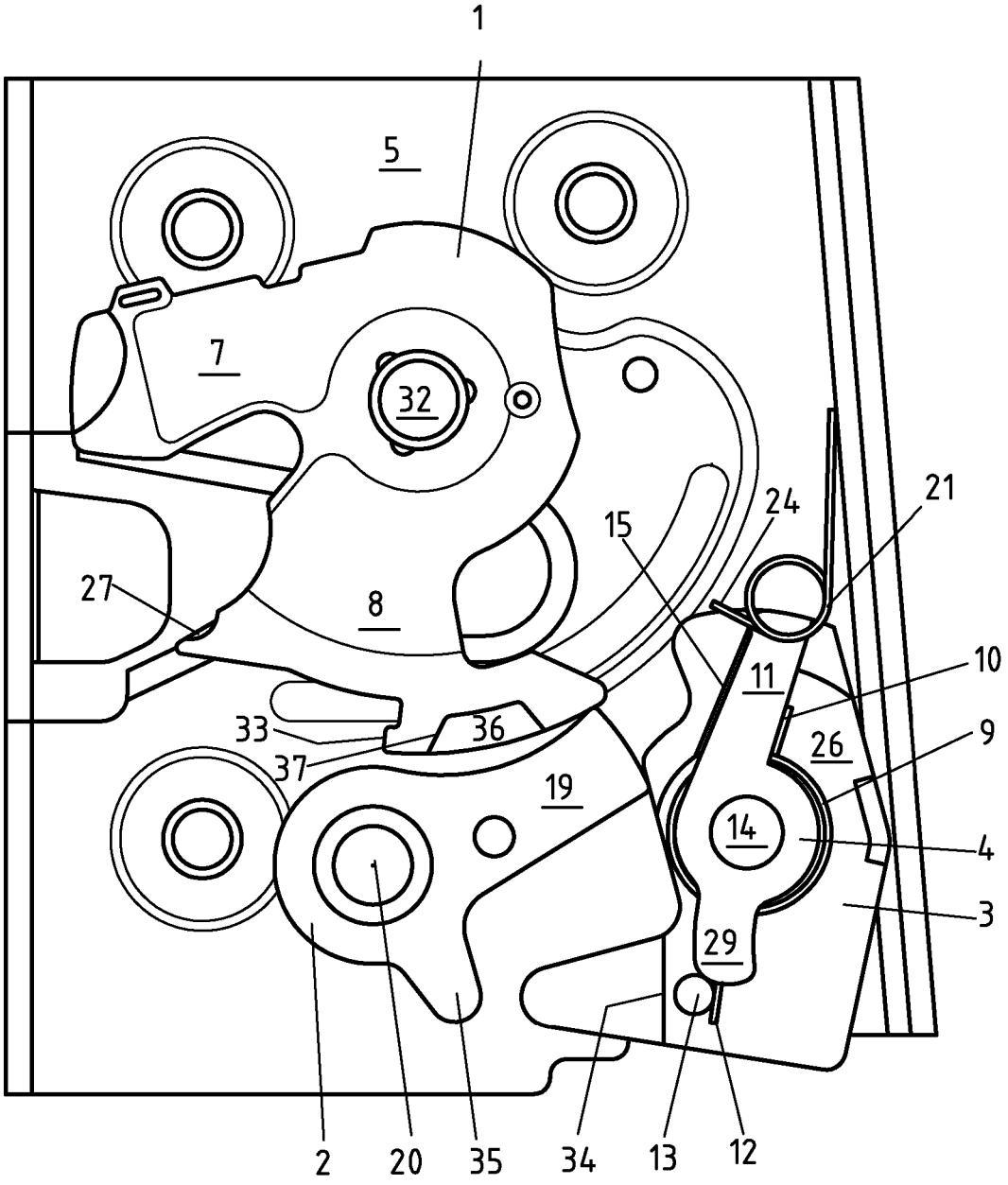
FIG. 5 is a top view of the locking mechanism in its opened position in accordance with the exemplary embodiment of the invention.

The further operation in order to disengage the locking mechanism is illustrated by the FIGS. 4 and 5. FIG. 4 shows a further intermediate state. FIG. 5 shows the open state.

In the intermediate state shown in FIG. 4, the arm 35 of the pawl 2 rests against the end portion of the arm 30 of the blocking lever when the pawl 2 has left its catching position. The interaction between the arm 35 of the pawl 2 and the arm 30 of the blocking lever 2 as illustrated by the FIGS. 3 and 4 makes sure that the pawl 2 leaves its catching position and will not turn back in the course of the opening operation. As a result, for example, dust or ice cannot prevent the pawl from leaving its catching position. In other words, the interaction between the arm 35 of the pawl 2 and the arm 30 of the blocking lever 2 serves as backup in order to remove the pawl from its catching position, if the opening moment is not sufficient for some reason. For this reason, the contour of the arm 35 and the contour of the end portion of the arm 30 run in such a ramp-like manner that the pawl 2 will rotate in a clockwise manner due to a rotation of the blocking lever 3, as well as due to the described interaction between the two arms 30 and 35.

FIG. 5 shows the rotary catch 1 in its opened position. The arm 19 of the pawl 2 rests against the contour of the end portion of the catching arm 8 of the rotary catch 1 due to the pre-stressed spring 16 (not shown in FIG. 5). The pre-stressed spring 16 causes in addition that the arm 26 of the blocking lever 3 rests against the end portion of the arm 19 of the pawl 2.

Figure 6:
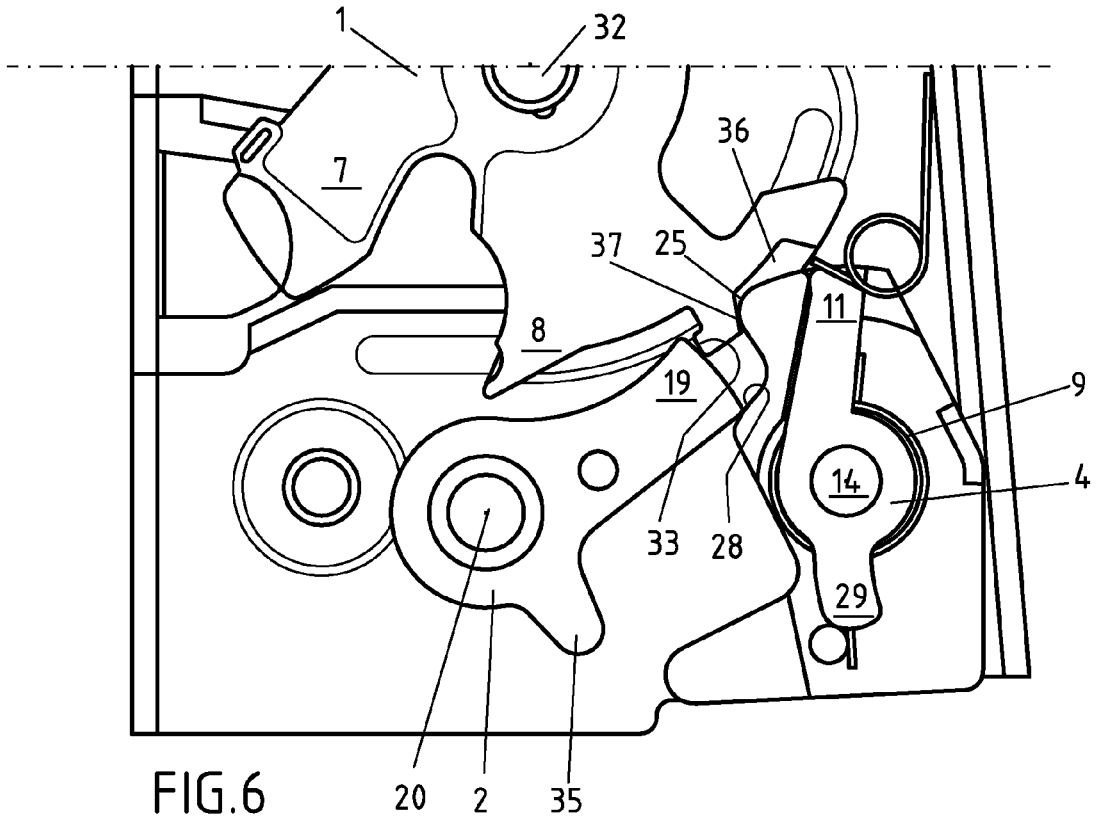
FIG. 6 is a top view of a locking mechanism in its preliminary locking position in accordance with an exemplary embodiment of the invention.
Figure 7:
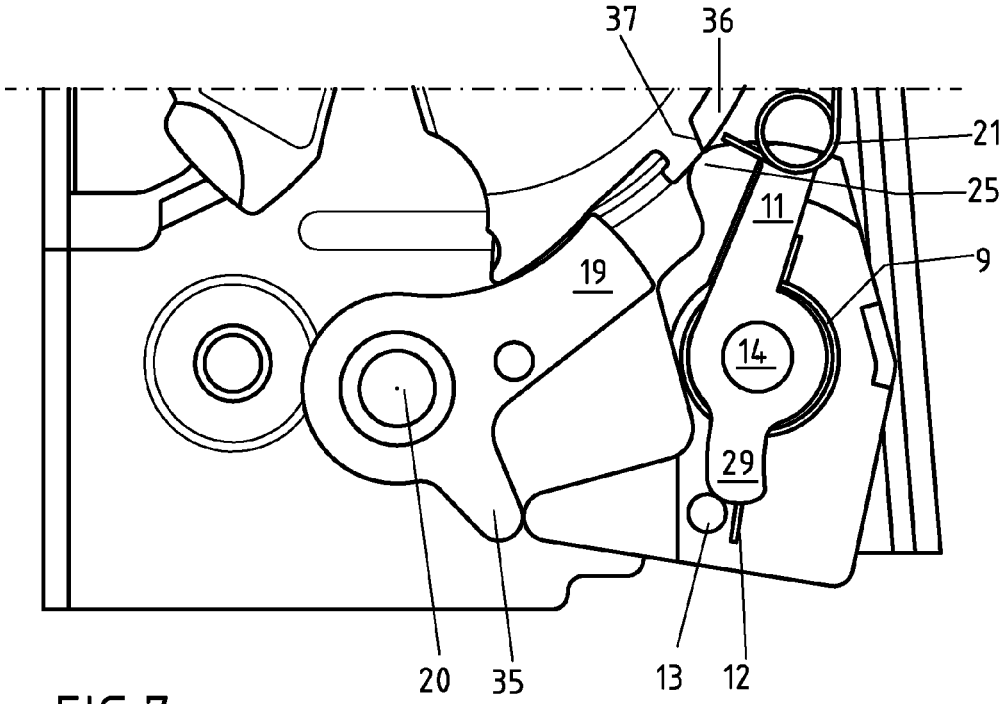
FIG. 7 is a top view of a locking mechanism in an intermediate state between the preliminary locking position and the main locking position in accordance with an exemplary embodiment of the invention.

Starting from the opened position shown in FIG. 5, rotation of the catch 1 in a counter-clockwise manner results that the pawl 2 engages the rotary catch in its preliminary locking position as shown in FIG. 6. Then, the tongue 25 enters the recess or dent 36 in the end portion of the catching arm 8 due to the pre-stressed second spring 16 (not shown in FIG. 6). In addition, the arm 19 of the pawl 2 enters its preliminary catching position as shown in FIG. 6. The second section 33 of the catching arm 8 rests against the end portion of the arm 19 of the pawl 2 so that the rotary catch 1 cannot rotate back in its opened position. In addition, the end portion of the arm 19 of the pawl 2 rests against the contour 28 nearby the end portion of the arm 26 of the blocking lever 3. The blocking lever 3 blocks the pawl 2 in its preliminary catching position. As a result, the pawl 2 cannot leave its preliminary catching position. In the preliminary position, the rotary catch introduces an opening moment into the pawl 2. For this reason, it is sufficient to remove the blocking lever 3 from its blocking position as shown in FIG. 6 in order to open the locking mechanism.

In the preliminary locking position, the tongue 25 rests against a ramp like portion 37 of the recess or dent 36. Due to the ramp like portion 37, rotation of the rotary catch 1 in a counter-clockwise manner causes the blocking lever 3 to leave its blocking position. Afterwards, the locking mechanism can be brought into its main locking position.

Figure 8:
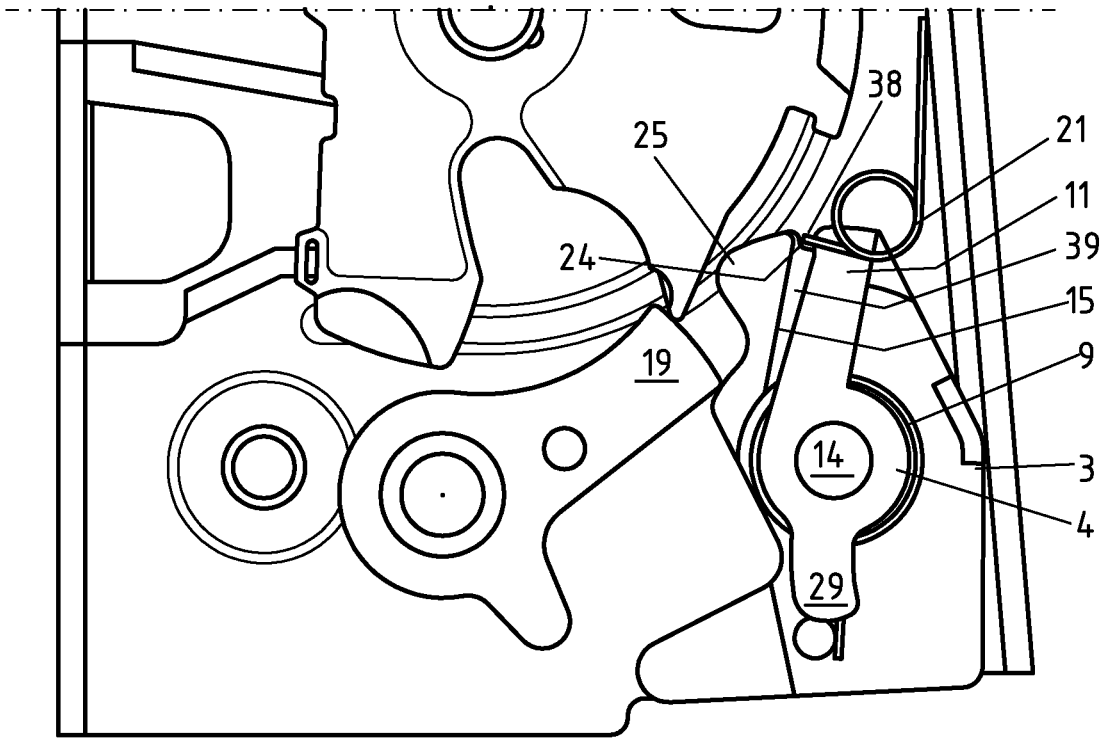
FIG. 8 is a top view of a locking mechanism as operative when excessively large accelerations manner occur, as can be caused by a crash, in accordance with an exemplary embodiment of the invention.

As referenced above, the blocking lever and the releasing lever move either together or independently relative to the first spring based on a magnitude of acceleration of the releasing lever. If in a locking position (preliminary locking position or main locking position) excessively large accelerations of the releasing lever 4 in a clockwise manner occur, as can be caused by a crash, then the releasing lever 3 is not moved together with the blocking lever 4 due to the large inertial mass of the blocking lever 3, as illustrated in FIG. 8. A gap or notch 38 results due to the movement of the releasing lever 4 between an end portion of the arm 26 of the blocking lever 3 and an end portion of the arm 11 of the releasing lever 4. When the notch 38 occurs, a bended end portion of the leg 24 of the pre-stressed third spring 21 enters the gap 38 as shown in FIG. 8. As soon as the bended end portion of the leg 24 has entered the notch 38, the blocking lever 3 cannot leave its blocking position. Then, the bended end portion of the leg 24 of the pre-stressed third spring 21 acts as a detent.

The end portion of the arm 26 of the blocking lever 3 includes an overlapping area 39. When the arm 11 of the releasing lever 4 rests against the side wall or elevation 15 of the blocking lever, the overlapping area 39 is completely below the arm 11 of the releasing lever 4. As a result, the bended end portion of the leg 24 of the third spring 21 cannot displace the arm 11 in such a manner that the notch 38 occurs.

If the operation of the releasing lever 4 is fast, the torque of the third spring 21 is insufficient to overcome the mass moment of inertia of the blocking lever 3. The first spring 9 deflects uncoupling the releasing lever 4 from the blocking lever 3. The relative movement of the releasing lever 4 uncovers the detent notch 38 in the blocking lever 3. The third spring 21, constrained in the housing of the lock, is allowed to expand into this notch 38. The moving leg 24 of the third spring 21 is then in shear with the fixed housing formed by the side wall 23 and the blocking lever 3. The shear force is only the counteraction of the third spring torque with no component of the crash load in this design. Continued operation of the releasing lever 4 only results in winding up the third spring 21.

The inertia mechanism is now latched in a locked state. The blocking lever 3 is not subjected to subsequent oscillations of the release chain throughout the remainder of the acceleration event. If the inertia lock is set unintentionally or there is no damage to the release chain, the spring is reset by cycling the locking mechanism.

Further benefits and improvements of the invention are:

Reduced number of components;

Reduced package size;

Reduced overall mass;

Reduced handle travels and efforts (free comfort with every active latch);

Safer positive latching of the inertia mechanism (bounce blocker);

Bounce blocker is not subjected to crash loads;

Flat stampings;

Only one special metallic component required (inertia mass pawl);

Reduced number of components involved in resisting crash loads;

Plug and play for existing latch foot prints.

The reference signs have the following meaning:

1: rotary catch
2: pawl
3: blocking lever
4: releasing lever
5: metal plate
6: fork-shaped inlet slot of the rotary catch
7: load arm of the rotary catch
8: catching arm of the rotary catch
9: first spring
10: leg of the first spring
11: arm of the blocking lever
12: leg of the first spring
13: pin of the blocking lever
14: axis
15: side wall
16: second spring
17: leg of the second spring
18: leg of the second spring
19: arm of the pawl
20: axis of the pawl
21: third spring
22: leg of the third spring
23: side wall of the metal plate
24: leg of the third spring
25: tongue of the blocking lever
26: arm of the blocking lever
27: section of a contour
28: section of the contour of the blocking lever
29: arm of the releasing lever
30: arm of the blocking lever
31: elevation of the blocking lever
32: axis of the rotary catch
33: second section of the contour of the rotary catch
34: step of the blocking lever
35: arm of the pawl
36: dent of the rotary catch
37: ramp like portion of the dent
38: notch
39: overlapping area Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. A lock for a motor vehicle comprising:

a locking mechanism comprising a rotatably mounted rotary catch for receiving a locking bolt, and a pawl with which the rotary catch can be engaged for retaining the locking bolt, a blocking lever that blocks the pawl when the pawl is located in a main catching position, wherein the blocking lever blocks the pawl by a surface of the blocking lever contacting a surface of the pawl, a releasing lever for placing the locking mechanism in a disengaged state, and a first spring that interconnects the blocking lever and the releasing lever, wherein the blocking lever and the releasing lever move together in response to a first acceleration of the releasing lever, and the releasing lever moves independently relative to the blocking lever in response to a second acceleration of the releasing lever, wherein a magnitude of the second acceleration is greater than a magnitude of the first acceleration;

and a second spring which moves the blocking lever into a blocking position in which the blocking lever blocks the pawl in the main catching position.

2. The lock of claim 1, wherein the mass of the blocking lever is more than two times larger than the mass of the releasing lever.

3. The lock of claim 1, wherein the blocking lever and the releasing lever rotate around the same axis.

4. The lock of claim 3, wherein one leg of the first spring is attached to or rests against the releasing lever, and another leg of the first spring is attached to or rests against the blocking lever.

5. The lock of claim 1, wherein the rotary catch introduces an opening moment onto the pawl in at least one of a main locking position and a preliminary locking position.

6. The lock of claim 1, wherein the blocking lever comprises an elevation which acts as a stop for the releasing lever.

7. The lock of claim 1, wherein the second spring comprises a first leg which rests against the blocking lever and a second leg which rests against an arm of the pawl adjacent an axis of the pawl.

8. The lock of claim 1 comprising a third spring which enters a notch between the releasing lever and the blocking lever when the releasing lever moves independently of the blocking lever due to the second acceleration.

9. The lock of claim 8, wherein an overlapping area of the blocking lever is below an arm of the releasing lever when the arm of the releasing lever rests against an elevation of the blocking lever.

10. The lock of the claim 1, wherein the blocking lever comprises a tongue which enters a dent of the rotary catch in a preliminary locking position of the rotary catch.

11. The lock of claim 10, wherein the tongue rests against a ramp portion of the dent in the preliminary locking position.

12. The lock of the claim 1, wherein the blocking lever may block the pawl in the main catching position and in a preliminary catching position.

13. A lock for a motor vehicle comprising:

a locking mechanism comprising a rotatably mounted rotary catch for receiving a locking bolt, and a pawl with which the rotary catch can be engaged for retaining the locking bolt;

wherein the rotary catch is rotatable between a main catching position and a preliminary catching position, and the pawl engages the rotary catch in the main catching position and the preliminary catching position;

a blocking lever that blocks the pawl when the rotary catch is located in the main catching position and in the preliminary catching position, and a releasing lever for causing the pawl to move out of engagement with the rotary catch in the main catching position and the preliminary catching position such that the locking mechanism is placed in a disengaged state, wherein the rotary catch introduces an opening moment onto the pawl when the pawl is in the main catching position and the preliminary catching position;

wherein the blocking lever comprises a tongue which enters a dent formed in the rotary catch in the preliminary catching position.

14. The lock of the claim 13, wherein the tongue rests against a ramp portion of the dent in the preliminary catching position.

* * * * *